United States Patent [19]

Freisler

[11] 4,294,290

[45] Oct. 13, 1981

[54] PROCESS AND LOOM FOR THE PRODUCTION OF PILE FABRICS

[75] Inventor: Erhard Freisler, Bubikon, Switzerland

[73] Assignee: Ruti Machinery Works Ltd., Ruti, Switzerland

[21] Appl. No.: 50,167

[22] Filed: Jun. 20, 1979

[30] Foreign Application Priority Data

Jun. 30, 1978 [CH] Switzerland ..... 7153/78

[51] Int. Cl.[3] ..... D03D 39/22; D03D 49/06

[52] U.S. Cl. ..... 139/26; 139/102

[58] Field of Search ..... 139/25, 27, 26, 102, 139/110

[56] References Cited

U.S. PATENT DOCUMENTS

| | | | |
|---|---|---|---|
| 1,322,671 | 11/1919 | Davis | 139/25 |
| 2,099,780 | 11/1937 | Van de Casteele | 139/26 |
| 2,625,956 | 1/1953 | Sippel | 139/26 |
| 3,920,052 | 11/1975 | Nelson | 139/25 |
| 4,112,981 | 9/1978 | Freisler | 139/102 |
| 4,122,873 | 10/1978 | Pfarrwaller et al. | 139/110 |

*Primary Examiner*—Chi Kee

*Attorney, Agent, or Firm*—Donald D. Denton

[57] ABSTRACT

The production of pile fabrics in which the stroke of the batten of a loom during operation is periodically decreased from the value corresponding to a full stroke of the batten by a value for partial strokes which is referred to as the pre-beating distance.

21 Claims, 5 Drawing Figures

PROCESS AND LOOM FOR THE PRODUCTION OF PILE FABRICS

BACKGROUND OF THE INVENTION

This invention relates to the production of pile fabric on a loom having a pile-warp beam, a ground-warp beam, and a batten the stroke of which during operation is periodically decreased from the value corresponding to a full stroke of the batten by a value for partial strokes which is referred to as the pre-beating distance.

In the manufacture of pile fabric, it is necessary, in order to obtain goods of good quality, that the quantity of pile-warp yarns fed and the pile-warp tension in the shed be as constant as possible. This requirement is imposed by the fact that variations in the ground-warp tension affect the pre-beating distance, which results in irregularities in the height of the pile.

The influence of changes in the ground-warp tension on the height of the pile results from the fact that with an increase in the tension of the ground warp, the so-called cloth advance, that is the movement of the fell of the cloth upon the backward swinging of the batten from its defined position in the direction towards the batten, becomes smaller so that the following pre-beating distance becomes greater. This in its turn leads to a greater height of pile.

The closest prior art known to the inventor is U.S. Pat. No. 4,112,981.

SUMMARY OF THE INVENTION

The present invention provides a process by the use of which the pile height remains constant even upon changes in the tension of the ground warp.

This purpose is achieved, in accordance with the invention, in the manner that during the weaving process the pre-beating distance is reduced or increased upon changes in the pile-warp tension.

It has been found that changes in the pile-warp tension are a suitable criterion for indicating irregularities in the height of the pile due to changes in the ground-warp tension, since the effect described above that the height of pile increases with an increase in the tension of the pile warp leads to the result that with a constant length of conveyance of the pile-warp yarns, the pile-warp tension increases.

The invention furthermore concerns a loom for the carrying out of said process, having a feed roller for withdrawing the pile-warp yarns from the pile-warp beam and a batten drive device which comprises a control mechanism for shifting the position of the beating-up position of the reed.

This loom is characterized by the fact that there is provided a control means which is connected to the control mechanism and can be activated upon changes of the pile-warp tension by a predetermined minimum value, the control mechanism being acted on by said control means in order to change the pre-beating distance.

In a preferred embodiment, the loom is characterized by the fact that the control means has a detector for detecting changes in the pile-warp tension, a motor which can be controlled by the detector, and a displacement means for changing the pre-beating distance which can be driven by the motor and is connected to the control mechanism.

BRIEF DESCRIPTION OF THE DRAWINGS

The invention will be described below in further detail on the basis of an illustrative example and the figures of the drawing in which.

DESCRIPTION OF PREFERRED EMBODIMENTS

Figure 1:
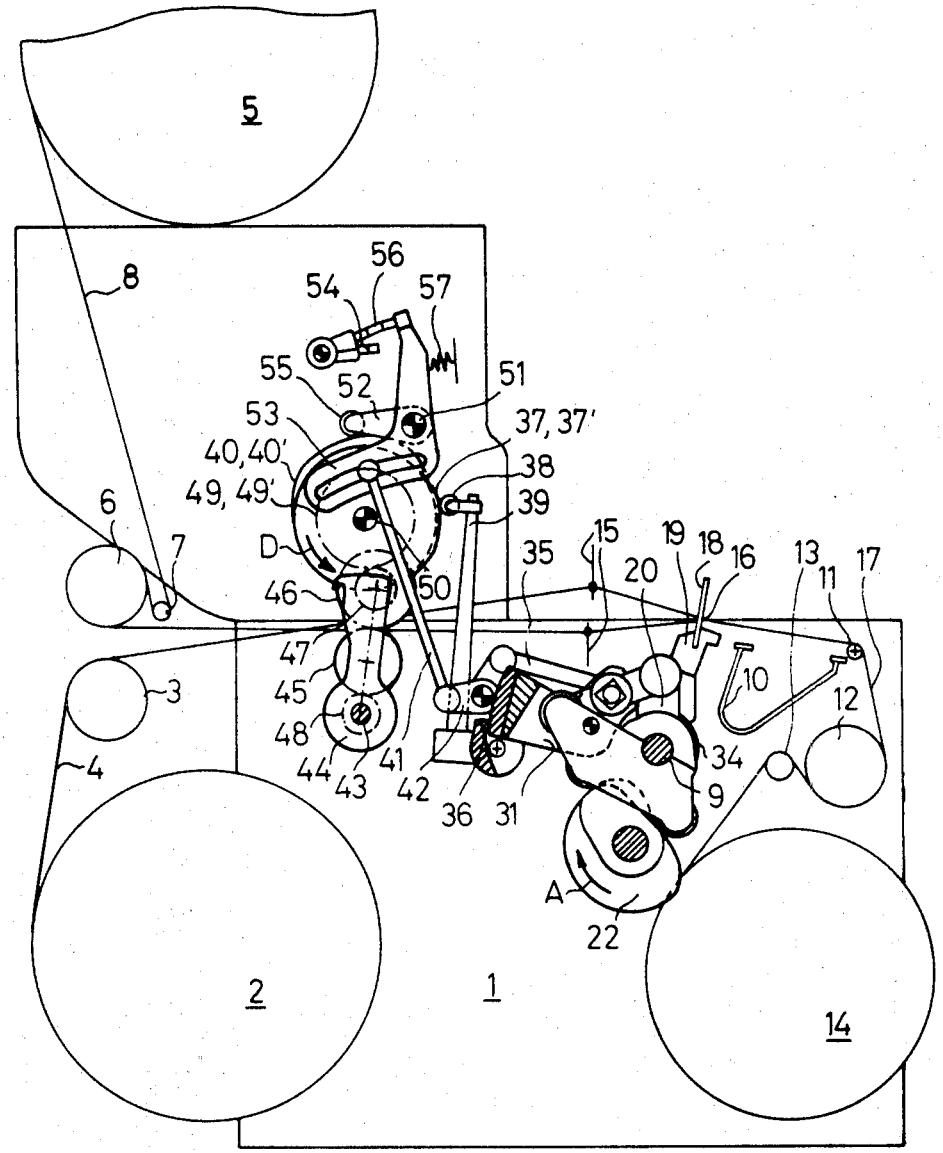
FIGS. 1 and 2 are each a schematic cross-section through a terry loom for two different beating-up positions of the reed.
Figure 2:
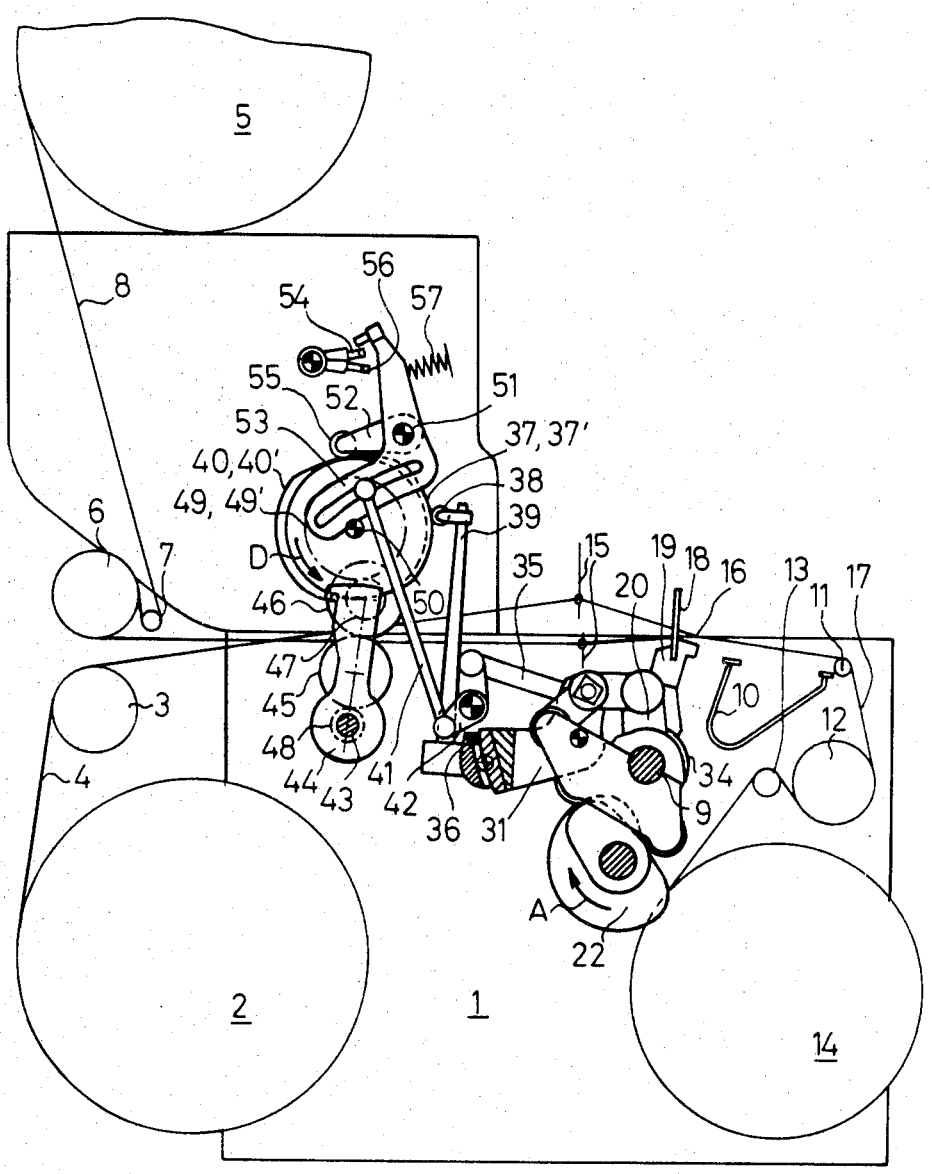
Figure 3:
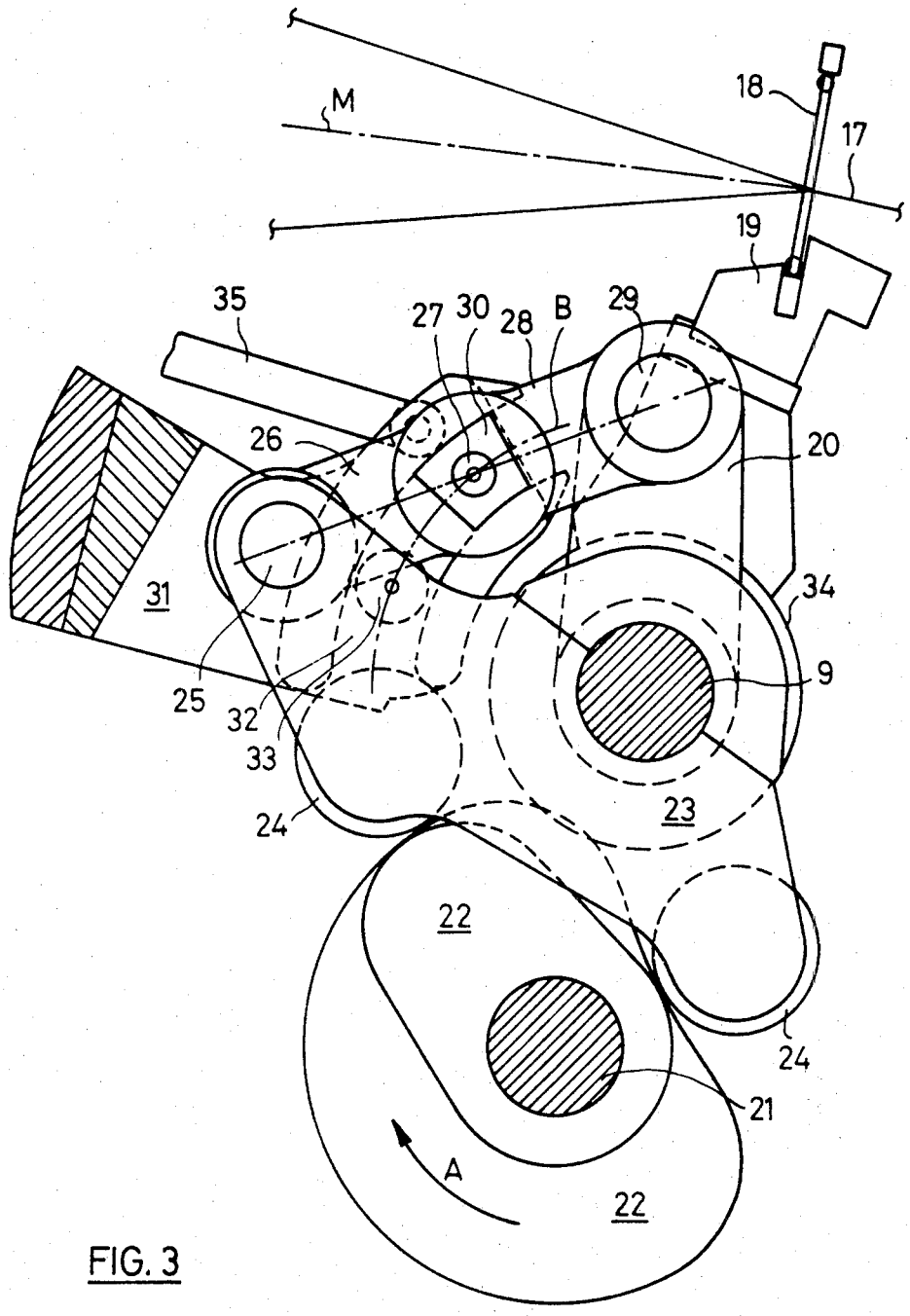
FIGS. 3 and 4 each shows details of FIGS. 1 and 2 respectively on a larger scale.
Figure 4:
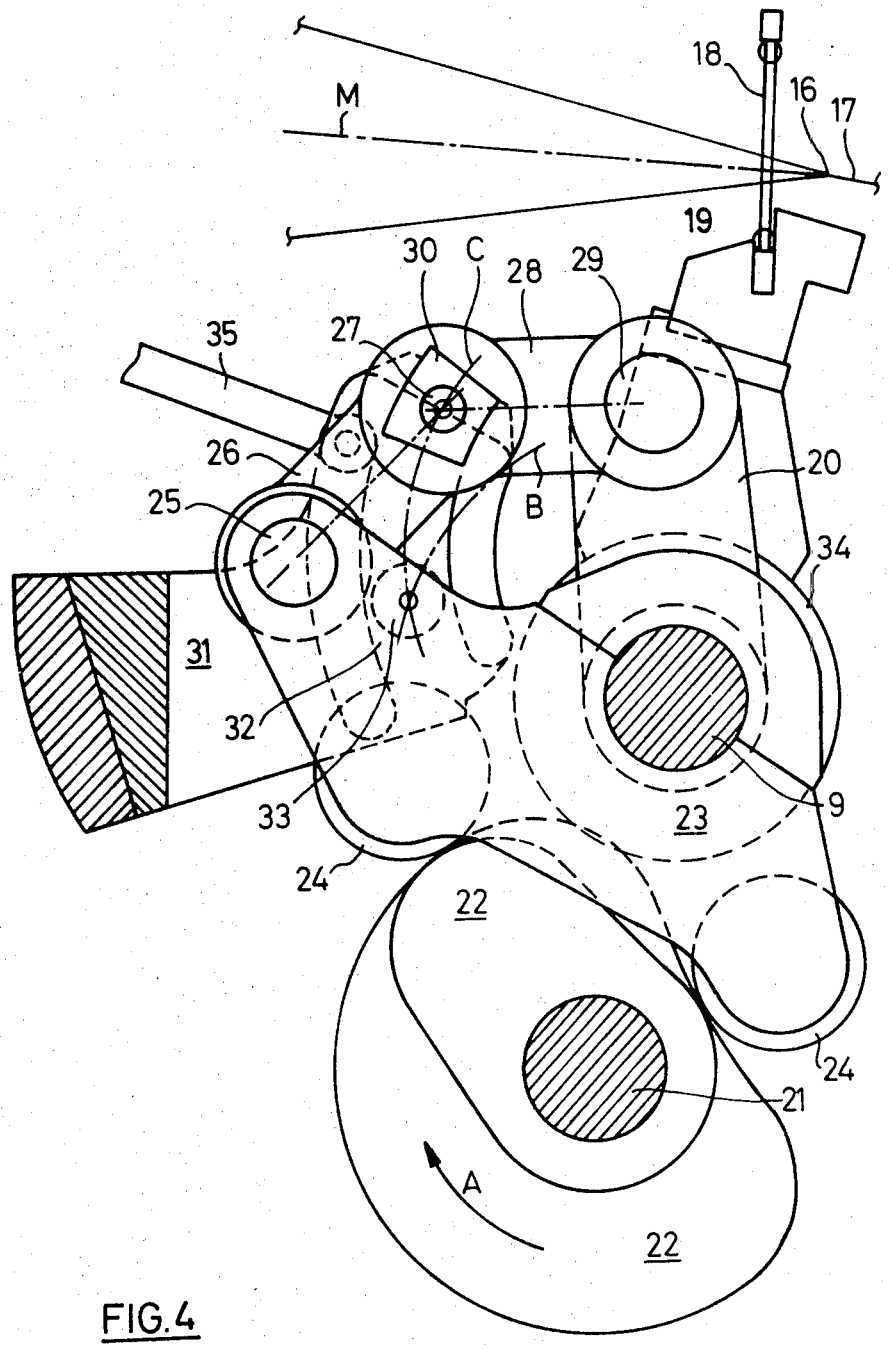
Figure 5:
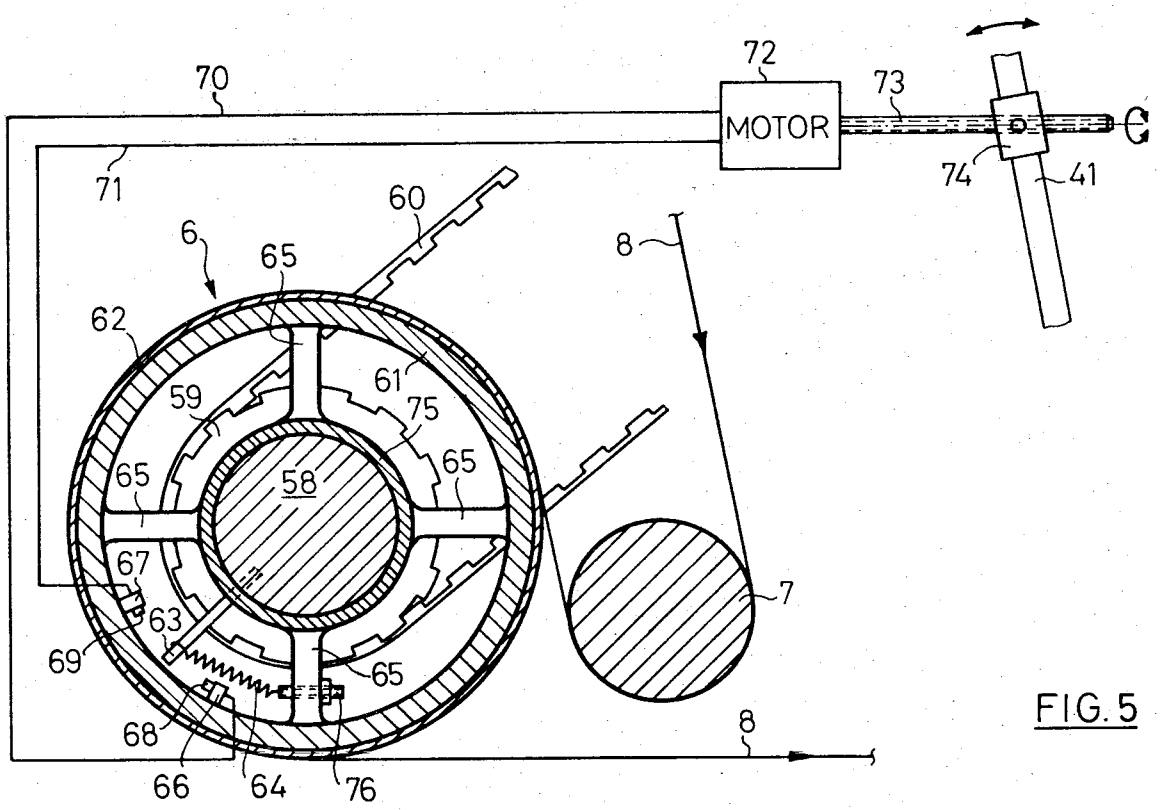
FIG. 5 shows a further detail of FIGS. 1 and 2, showing diagrammatically a detector operatively connected to a motor for detecting changes in pile-warp tension.

In FIGS. 1 and 2 there is shown a terry loom whose reed is in full beat-up position in FIG. 1 and in partial beat-up position in FIG. 2. FIGS. 3 and 4 show on a larger scale a view of the batten path shortening mechanism for the fully beat-up position (FIG. 3) and for the partial beat-up position (FIG. 4). FIG. 5 shows diagrammatically the device for changing the pre-beating distance as a function of changes in the pile-warp tension.

The terry loom shown in the figures has a machine frame with two sidewalls, of which the right side wall 1 is diagrammatically shown. Between the side walls there are arranged a ground-warp beam 2 with a spreading roller 3 for the ground warp 4, a pile-warp beam 5 with a feed roller 6 and a floating roller 7 for the pile warp 8, a batten shaft 9, a breast bar 10, a spreading roller 11, a take-up roller 12, a guide roller 13, and a cloth beam 14. The yarns of the ground warp 4 and of the pile warp 8 are fed via shed-forming heddles 15, by which they are subjected to shedding, to the fell of the cloth 16. The cloth formed is designated 17 and is wound on cloth beam 14 during operation of the loom. On the batten shaft 9 there are swingably mounted the batten tube 34 which bears the batten 19 with the reed 18, and a batten lever 20 which is rotatably connected with the batten tube 34.

The drive of the batten lever 20 will now be described by reference to FIGS. 3 and 4: Two cams 22 are flrmly mounted on a drive shaft 21 which can be driven by a motor in the direction indicated by the arrow A. Associated with the cams 22 is a roller lever 23 which is turnably mounted on the batten shaft 9 and on which two rollers 24 turnable on the face of cams 22 are rotatably supported. The roller lever 23 is provided at its left end, as seen in the figures, with a supporting shaft 25 on which there is mounted a first lever 26. The free end of the first lever 26 is clamped onto a shaft 27 on which there are turnably mounted the one ends of a second double-sided lever 28. The other ends of the second double-sided lever 28 are pivotally connected via a shaft 29 with the batten lever 20. On the shaft 21 which connects the first lever 26 with the second lever 28, separate slide blocks 30 are turnably mounted on both sides of the said levers. The first lever 26 and the second lever 28 together form a toggle joint, the angle of bend of which can be controlled via the slide blocks 30.

Operably associated with the slide blocks 30 is a double-sided control lever 31. Each side of the control lever 31 is provided with a separate guide groove 32 having the shape of a circular arc for the slide blocks 30. The control lever 31 is swingably supported around two bearing pins 33 arranged on both sides and it is pivoted at its right-hand upper end, as seen in the figures, to a control rod 35.

The roller lever 23, the toggle lever formed by the first lever 26 and the second lever 28, and the batten lever 20 together form a link quadrilateral, the angle of bend of the toggle joint representing a characteristic value for the size of the stroke of the batten 19. The articulation points of the said link-quadrilateral are established by the batten shaft 9, the bearing shaft 25, the shaft 27, and the shaft 29. As is known, when producing terry cloth one operates in the manner that, within a three-pick or four-pick cycle, a full beating takes place for every two or three partial beating movements respectively of the reed, and upon this full beating the three or four picks are finally beaten up and the loops formed by the pushing together of the partially beaten-up filling yarns.

The periodic shortenings of the batten stroke which are necessary for the partial beatings are obtained by displacement of the angle of bend of the toggle joint formed by the first lever 26 and the second lever 28 by changing the geometry of movement of the said link quadrilateral. This is done by the control lever 31 via the slide blocks 30. When the batten 19 is in its rear backward-swung position, the toggle joint is extended and the link quadrilateral has been converted into a link triangle. The pivot point of the control lever 31, i.e. the axes of the bearing pins 33 on the two sides, coincides at this moment with the axis of the shaft 27 which forms the pivot point of the toggle joint.

In its backward-swung position, the batten 19 stops. At this time of stop, the displacement of the control lever 31 takes place. If the next beating is to be a full beat-up, then the control lever 31 is swung in clockwise direction into the position shown in FIG. 3. In this way, the pivot point of the control lever 31 and the pivot point of the toggle joint formed by the first lever 26 and the second lever 28 lie on a common circular arc B, shown in dash-dot line in FIG. 3, having its center point in the axis of the batten shaft 9 and therefore in the center of swing. The pivot point of the shaft 29 is associated via the batten lever 20 with a different lever-arm length with the same center of swing. Thus, the toggle joint remains in its extended position for the entire full-beating cycle.

If the next beat-up is to be a partial beating in accordance with FIG. 4, then the control lever 31 is swung in counterclockwise direction by an angle which depends on the pre-beating distance and therefore on the distance on the line of symmetry M of the shed between the batten position for full beating and that for partial beating. This position of the control lever 31 determines a new central path C of the curve formed by the guide groove 32, which curve no longer has its center in the center of swing and therefore in the axis of the batten shaft 9.

In this way, the turning point of the toggle joint during the swinging movement produced by the roller lever 23 is forced, via the shaft 27 turnably supported in the slide blocks 30, to slide along the new curved path C and to produce, in positive manner, a link quadrilateral from the link triangle.

Upon this outward bending movement of the toggle joint formed by the first lever 26 and the second lever 28, the bearing places of the slide blocks 30 on the shaft 27 serve as support points for maintaining equilibrium for the force of reaction resulting from the force parallelogram. This force of reaction acts on lever arms of different length. Depending on the position of the pivot point of the toggle joint, the force of reaction imparts to the control lever 31 a torque of varying amount and direction during the movement cycle. This torque is taken up, in accordance with FIGS. 1 and 2, by a stop which comprises a stop jaw 36, said stop being done away with in the backward-swung position of the batten 19 by stop eccentrics 37, 37' via a roller 38 and a spring bar 39.

The relative position of rest of the batten 19 during the changes in position of the control lever 31 brings it about that upon these changes in position only the inertia forces of the parts participating in the change in position are present throughout the entire drive system for the batten 19. This fact is of particularly great importance for looms in which the insertion of the filling, which takes place during the position of rest of the batten 19, is effected with gripper heads which lie on the batten path and are fastened to bars or flexible ribbons. Due to the extended position of the toggle joint upon full beating, no forces of reaction resulting from inertia or drive forces and acting on the control or stop mechanism occur either.

In accordance with FIGS. 1 and 2, the actuating of the control lever 31 is effected by control cams 40, 40' via a control rod 41 of adjustable lift, a bell-crank lever 42 supported on a pivot axis which is fixed to the machine, and the control rod 35. Of the control cams 40, 40' as well as of the stop cams 37, 37' one cam in each case is intended for three-pick operation and one for four-pick operation. In order to obtain full ability of return of the various control movements with the batten 19 stationary in case of break of the filling, the drive of the cam-actuated stop jaw 36 and the cam drive for the control lever 31, both of which are arranged in the construction above the machine wall 1, are derived from a returnable driven auxiliary shaft 43.

For this purpose, a rocker 44 is swingably supported on the auxiliary shaft 43 and three intermediate gear wheels 45, 46, and 47 are rotatably supported in it. The lowermost gear wheel 45 is in engagement with a gear wheel 48 which is mounted fixed on the auxiliary shaft 43 and, via the gear wheel 46, drives the gear wheel 47 which is connected for rotation with the latter. The gear wheel 47 is in engagement with a driven gear wheel 49, 49' connected for rotation with the control cam 40, 40' and the direction of rotation of which is indicated by an arrow D. The driven gear wheel 49 or 49' and corresponding control cam 40 or 40' and stop cam 37 or 37' flanged onto said gear wheel are pushed over a fixed shaft 50. In order to change from three-pick weave to four-pick weave and vice versa, the rocker 44 is swung out, whereupon control cam 40 or 40' with stop cam 37, 37' and driven gear wheel 49 or 49' can be changed. In case of three-pick weaving, the driven gear wheel 49 travels at one-third of the speed of rotation of the main shaft, while in the case of four-pick weaving it travels at one-fourth the speed thereof.

The angle of swing produced by the control cam 40 or 40' is transmitted to a thrust crank 53 which is connectedly fixed for rotation with a hollow shaft 51 and a roller lever 52. By preselection of variable lever-arm ratios on the driving swivel arm of the thrust crank 53, a variable working stroke is produced as a function of the pre-beating distance desired and is transmitted to the batten-path shortening control consisting of the control rod 41, the bell crank lever 42, and the control rod 35. The lever-arm ratio is in this connection adjusted to the larger of two desired heights of pile. For the production of the shorter height of pile, the roller lever 52 is prevented by an inward-swingable first underlaying finger 54 from following the control cam 40 or 40' entirely into its valley, i.e. the roller 55 of the roller lever 52, at a given portion of the circumference of the control cam 40 or 40', lifts off from the latter. In this way the thrust crank 53 is transmitted only a part of the angle of swing.

By a second, longer underlaying finger 56 the roller 55 can be permanently raised from the control cam 40, 40' so that upon the inward swing of this underlaying finger full stops are always obtained for the batten 19 and therefore a smoother fabric is produced. Upon the production of terry-cloth with the larger pile height, of course, neither of the two underlaying fingers 54 or 56 is swung inward. For the pressing of the roller 55 against the control cam 40, 40' there is provided a compression spring 57. The control of the inward swinging of the underlaying fingers 54 and 56 is effected by the shed-forming machine or, when using a drum treadle, by the central function-control device.

FIG. 5 shows diagrammatically the feed roller 6, the floating roller 7 and the control rod 41 (FIGS. 1, 2). Feed and floating rollers 6, 7 are fastened to the machine frame in the manner described in U.S. Pat. No. 4,112,981 issued Sept. 12, 1978, which is made a part of this application by reference. The feed roller 6 consists of a support roller 58 which is rigidly connected at its one end to a gear wheel 59 and consists of a jacket tube 61 of light metal or plastic. The gear wheel 59 is driven, stepwise or continuously, from the pile switch mechanism (not shown) via a toothed belt 60. The jacket tube 61 is connected by spokes 65 with a hub 75 which is rotatably supported on the support roller 58 and is provided on its outer surface with a driving covering 62, preferably a plush covering.

On the support roller 58 there is fastened a pin 63 which extends outward through its cylindrical wall. On this pin 63 there acts the one end of a spring 64 whose other end is fastened to the jacket tube 61, as shown in the drawing, on a threaded spindle 76 adjustably supported in a spoke 65. The spring 64 counteracts the pile-warp tension and assures the transmission of force from the support roller 58 to the jacket tube 61 so that the latter participates in the turning movements of the support roller 58 for the feeding of the pile warp yarns 8.

The strength of the spring 64 thus determines the tension of the pile warp. Since this spring strength is adjustable via the threaded spindle 76, operation is considerably facilitated, since now, in the case of a new article, it is merely necessary for the feed length of the pile warp yarns and their correct tension to be adjusted while previously pre-beating distance and length of feed had to be adapted to each other by a tedious procedure. This adaptation is now effected automatically.

On the inside of the jacket tube 61 there are mounted two stops 66 and 67 which bear electric switches 68 and 69 respectively extending into the path of movement of the pin 63. The switches 68 and 69 are operatively connected via lines 70, 71 with a motor means 72 drivable from a source of current not shown. The motor means 72 drives a threaded spindle 73 which is supported in a nut 74 pivotally mounted on the control rod 41. Since the motor means 72 is firmly attached to the loom frame, a turning movement of the threaded spindle 73 means a displacement of the nut 74 and thus a displacement of the upper end of the control rod 41 in the guide groove of the thrust crank 53 (FIGS. 1, 2). The latter effects a displacement of the prebeating distance. The motor means 72 contains a time member (not shown) in the form of a counter by which the rotation of the threaded spindle 73 is disconnected after an adjustable number of revolutions or after a given period of time.

As can be noted from FIG. 5, in case of too high a tension of the pile warp, the jacket tube 61 is turned by the pile warp yarns 8 in counterclockwise direction relative to the support roller 58 against the force of the spring 64. As a result, the switch 69 comes into contact with the pin 63 and is actuated. In this way, a signal arrives via the line 71 at the motor means 72 which drives the threaded spindle 73 in one direction. By the rotation of the threaded spindle 73, the nut 74 is moved to the right, together with the control rod 41 (FIGS. 1, 2), which results in shortening of the pre-beating distance. In the event of too low a tension of the pile warp, the switch 68 is actuated and the threaded spindle is driven in the other direction, as a result of which nut 74 and control rod 41 are moved to the left and the prestroke distance is lengthened.

It will be appreciated that switches 68 and 69 can be actuatable by mechanical contact or they can be developed as proximity switches. Similarly, the determination of the change of the pile-warp tension could be effected in some other manner by other types of detection means. Thus, for instance, a fixed driver, in the manner of the pin 63, could be fastened to the support roller 58 and a resilient driver, associated with it, could be fastened to the jacket tube 61. The resilient driver could bear a signal arm which would extend into the space between two switches fastened to the support roller 58.

It would also be possible to connect the jacket tube 61 firmly to the support roller 58 and to guide the pile-warp yarns 8 behind the feed roller 6 over a resiliently supported swing roller and detect changes of the pile-warp tension on the basis of swinging movements of this swing roller. This swing roller could be supported by arms mounted on the common shaft of support roller 58 and jacket tube 61 or arms supported on the shaft of the floating roller 7. The swinging movement of these arms could be detected.

It will be understood that the drive device for the batten comprises a control mechanism for shifting the beat-up position of the reed, there being a control means operatively connected to the control mechanism so that control means is activated upon a change of the pile-warp tension by a predetermined minimum value, by which means the control mechanism can be acted on in order to change the pre-beating distance.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A process of producing pile fabric with pile or terry loops of constant height, on a loom having a pile-warp beam, a ground-warp beam and a batten the stroke of which in operation is shortened periodically from the value corresponding to a full beating-up of the batten by a value for partial beatings referred to as the pre-beating distance, characterized by the fact that during the weaving process the pre-beating distance is decreased or increased upon variations in the tension of the pile warp.

2. A process according to claim 1 in which the pre-beating distance is reduced upon an increase in the tension of the pile warp and increased upon a decrease in the tension of the pile warp.

3. A process according to claim 2 in which the pre-beating distance is in each case increased or decreased by a given adjustable value.

4. A loom for producing pile fabric with pile or terry loops of constant height, having a pile-warp beam, a ground-warp beam, a batten, and a feed roller for withdrawing pile-warp yarns from the pile-warp beam and having a drive device for the batten which comprises a control mechanism for shifting the beating-up position of the reed, comprising control means operatively connected to said control mechanism and activatable upon the changes of the pile-warp tension by a predetermined minimum value, by which means the control mechanism can be acted on in order to change the pre-beating distance.

5. The loom according to claim 4 in which the control means has a detector means for determining changes in the pile-warp tension, a motor means controlled by said detector means, and a displacement member for changing the pre-beating distance, which member can be driven by the motor means and is connected to the control mechanism.

6. The loom according to claim 5 in which the control mechanism has a control rod which is displaceable relative to the drive mechanism of said control means in order to change the prebeating distance, and the displacement member is formed by a nut mounted on the control rod and by a threaded spindle which on the one hand travels in said nut and on the other hand can be driven by the motor means.

7. The loom according to claim 6 in which the threaded spindle upon each activation of the motor means by the detector means is driven in each case a given number of revolutions.

8. The loom according to claim 5 in which the feed roller is formed of a support roller and a jacket tube which is rotatably supported on said support roller and driven via a driver member, and said detector means is positioned to detect relative movements between the jacket tube and the driver member.

9. The loom according to claim 7 in which the feed roller is formed of a support roller and a jacket tube which is rotatably supported on said support roller and can be driven via a driver member, and the detector means is positioned to detect relative movements between the jacket tube and the driver member.

10. A loom according to claim 8 in which the driver member is in the form of a stick which is fastened to the support roller and is operatively connected with said jacket tube via a spring which acts in opposition to the pile-warp tension.

11. A loom according to claim 9 in which the driver member is in the form of a pin which is fastened to the support roller and is operatively connected with said jacket tube via a spring which acts in opposition to the pile-warp tension.

12. The loom according to claim 10 in which an adjusting means is operatively attached to said spring for adjusting the tension of the spring.

13. The loom according to claim 11 in which an adjusting means is operatively attached to said spring for adjusting the tension of the spring.

14. The loom according to claim 12 in which the detector means includes two spaced switches mounted on said jacket tube, one at each end of the path of movement of the pin, said switches being electrically connected with the motor means.

15. The loom according to claim 13 in which the detector means includes two spaced switches mounted on said jacket tube, one at each end of the path of movement of the pin, said switches being electrically connected with the motor means.

16. The loom according to claim 14 in which said drive of the threaded spindle takes place in one direction upon the actuation of the one switch and in the other direction upon the actuation of the other switch.

17. The loom according to claim 15 in which said drive of the threaded spindle takes place in one direction upon the actuation of the one switch and in the other direction upon the actuation of the other switch.

18. The loom according to claim 5 in which a swing roller is arranged behind said feed roller as seen in the direction of transport of the pile-warp yarns, the pile-warp yarns being guided around said swing roller; and the detector means is developed to detect swinging movements of the swing roller.

19. The loom according to claim 7 in which a swing roller is arranged behind the feed roller, pile-warp yarns being guided around said swing roller to said feed roller, and said detector means developed to detect swinging movements of the swing roller.

20. The loom according to claim 18 in which said swing roller is mounted on arms supported on the shaft of said feed roller or on the shaft of said floating roller associated with the feed roller; and said detector means is developed to detect swinging movements of said arms.

21. The loom according to claim 19 in which the swing roller is mounted on arms supported on the shaft of said feed roller or on the shaft of said floating roller associated with the feed roller; and said detector means is developed to detect swinging movements of said arms.

* * * * *